US006176731B1

(12) United States Patent
Aoyama et al.

(10) Patent No.: US 6,176,731 B1
(45) Date of Patent: Jan. 23, 2001

(54) ELECTRICAL CONNECTOR HOUSING WITH CAVITY AND TERMINAL FITTING WITH INSULATION DISPLACEMENT CONTACT BLADES AND METHOD OF ATTACHING A WIRE THERETO

(75) Inventors: Masahiko Aoyama; Mitsugu Furutani; Hitoshi Okumura; Keigo Atsumi, all of Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/081,067

(22) Filed: May 19, 1998

(30) Foreign Application Priority Data

May 27, 1997 (JP) ..... 9-137206

(51) Int. Cl.[7] ..... H01R 4/24
(52) U.S. Cl. ..... 439/399; 439/407; 29/866
(58) Field of Search ..... 439/397, 398, 439/399, 400, 406, 407, 387–408, 395; 29/857, 858, 861, 863, 865–867

(56) References Cited

U.S. PATENT DOCUMENTS

| | | | | |
|---|---|---|---|---|
| 2,656,469 | | 6/1991 | France . | |
| 2,703,520 | | 10/1994 | France . | |
| 3,959,868 | | 6/1976 | Mathe . | |
| 4,296,988 | * | 7/1998 | Warner | 439/398 |
| 4,344,665 | | 8/1982 | Racilla et al. | 439/407 |
| 5,018,269 | | 5/1991 | Ishida et al. . | |
| 5,575,061 | | 11/1996 | Tsuji et al. | 29/863 |
| 5,581,879 | | 12/1996 | Tsuji et al. . | |
| 5,782,650 | * | 7/1998 | Okabe | 439/399 |
| 5,794,332 | * | 8/1998 | Yamamoto et al. | 29/863 |

FOREIGN PATENT DOCUMENTS 6-111909 4/1994 (JP) .

* cited by examiner

*Primary Examiner*—Brian Sircus
(74) *Attorney, Agent, or Firm*—Banner & Witcoff, Ltd.

(57) ABSTRACT

A blade type terminal fitting (7) has blades (14A, 14B) which cut through wire insulation (16) to contact a wire core (17). To prevent widening of the blades (14A, 14B) as the wire is pressed in, a jig (18) includes pressing members (20) to prevent outward movement of the blades (14A, 14B). A more secure electrical connection is obtained.

8 Claims, 3 Drawing Sheets

ELECTRICAL CONNECTOR HOUSING WITH CAVITY AND TERMINAL FITTING WITH INSULATION DISPLACEMENT CONTACT BLADES AND METHOD OF ATTACHING A WIRE THERETO

TECHNICAL FIELD

The present invention relates to an electrical connector, and to a pressure contact method for attaching an electric wire thereto.

BACKGROUND TO THE INVENTION

FIGS. 5 and 6 of this specification show a connector which permits the electrical connection of a terminal fitting 41 and an electric wire 42. The electric wire 42 is inserted from above by means of a jig 44 into the terminal fitting 41 which is installed within a connector housing 40. The terminal fitting 41 employed in this type of connector has pressure contact blades 43 facing inwards from both sides of the central portion, the insulated electric wire 42 being pressed onto the blades 43 from above. When this pressing-in occurs, the core of the electric wire 42 and a portion of the pressure contact blades 43 come into contact since the blades 43 cut into the insulated covering.

However, when the electric wire 42 is pressed into the terminal fitting 41 from above, the pressure contact blades 43 are pushed in an outward direction (the directions shown by F in the diagram). As a result the pressure contact blades 43 change shape so as to widen, preventing an effective pressure contact state from being achieved.

The present invention has been developed after taking the above problem into consideration, and aims to provide a connector and a pressure contact method for attaching an electric wire to a terminal fitting in which the widening of the terminal fitting is controlled at the time when the electric wire is pressed in.

SUMMARY OF THE INVENTION

According to the invention there is provided an electrical connector comprising a housing having a cavity therein, and an electrical terminal within said cavity, the terminal having blade members defining a slot to receive an electrical wire by pressure contact wherein said terminal is adapted for direct engagement with an assembly jig in the vicinity of said blade members whereby as said jig pushes a wire into said slot, said blade members are held against mutual outward movement tending to widen said slot.

Such a connector has the advantage that the wire receiving slot is not widened on entry of the wire. Accordingly, the electrical connection is improved, and the terminal may be made of a thinner metal gauge.

Preferably the blade members protrude from the housing so as to permit direct engagement with an assembly jig. The side walls of a connector housing may be cut away to facilitate this protrusion.

In a preferred embodiment, the assembly jig includes depending limbs to both engage the blade members, and to push a wire into the slot. Where multiple terminals are provided, one limb may support blade members of adjacent terminals. These support limbs are preferably spring loaded and having a form locking engagement with the connector housing.

The invention also provides a method of inserting a wire into a slot of a blade connector, the method comprising the steps of placing a wire over the slot, engaging the terminal in the vicinity of the blade members so as to prevent widening of the slot and pushing a wire into said slot.

BRIEF DESCRIPTION OF DRAWINGS

Other features of the invention will be apparent from the following description of a preferred embodiment shown by way of example in the accompanying drawings in which:

FIG. 3 is a partial cross-sectional view of the terminal fitting before an electric wire is pressed in.

FIG. 4 is a partial cross-sectional view of the terminal fitting after the electric wire is pressed in.

FIG. 5 is a partial cross-sectional view of a prior art example showing a terminal fitting before an electric wire is pressed in.

FIG. 6 is a partial cross-sectional view of the prior art example showing the terminal fitting after the electric wire is pressed in.

DESCRIPTION OF PREFERRED EMBODIMENT

Figure 1:
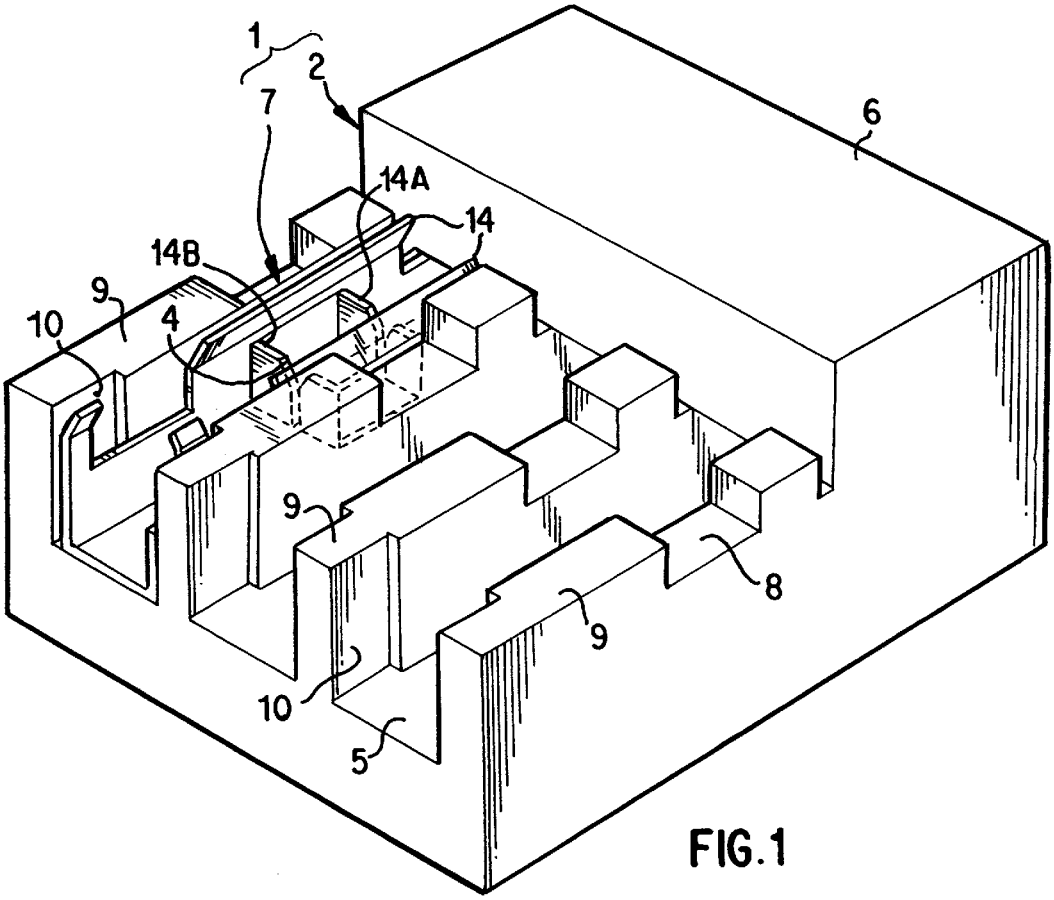
FIG. 1 is a diagonal view of a present embodiment showing a terminal fitting fitted to a connector housing.
Figure 2:
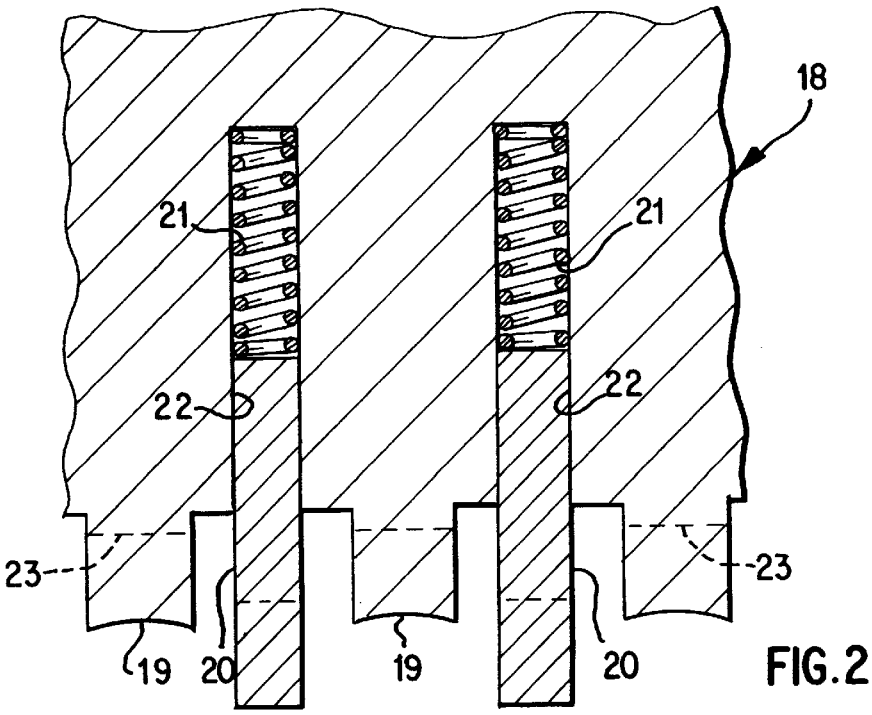
FIG. 2 is a cross-sectional view through a pressure contact mould.

An embodiment of the present invention is explained with the aid of FIGS. 1 to 4. A connector 1 shown in FIG. 1 comprises a connector housing 2, a terminal fitting 7 and a cover (not shown) which is attached to the connector housing 2 from above.

The female connector housing 2 is formed in a unified manner from synthetic resin in a schematically rectangular parallelepiped shape. The female terminal fitting 7 is attached to the female connector housing 2 which fits with a male connector housing (not shown). That is, the connector housing 2 is formed in such a way that the anterior portion is larger than the posterior portion, and that it has a hood member 6 which can be fitted with the corresponding male connector housing. The posterior end is open from above and its interior is divided into three cavities 5 by walls 9. Each cavity 5 houses a terminal fitting 7. The anterior ends of these terminal fittings 7 are not shown, but they are inserted into the hood member 6 as far as the anterior end thereof so as to be able to make contact with the terminal fittings housed within a corresponding connector housing. Cut-out portions 8 are formed on that section of the walls 9 where pressure contact blades 14A and 14B (to be described later) of the terminal fitting 7 are located, a portion of a pressure contact member 14 protruding beyond the cut-away walls 9. Further, the posterior ends of the walls 9 have relatively wide jig grooves 10 formed at the location of a barrel member 13 of the terminal fitting 7. When the terminal fitting 7 (to be explained below) is fixed into the cavity 5, the jig groove 10 is the only portion where a space occurs between the terminal fitting 7 and the cavity 5.

As described above, when the terminal fitting 7 is housed within the connector housing 2, the connector housing 2 can be fitted with a removable cover to close off each cavity 5.

The terminal fitting 7 is formed from an electrically conductive metal plate which is bent by means of a press process. The anterior portion of the terminal fitting 7 has a contact member (not shown) which makes contact with a corresponding terminal fitting (also not shown), and the posterior portion has a barrel member 13 for making pressure contact with a wire 15. The barrel member 13 comprises a pair of left and right protrusions mutually displaced in the anterior-posterior direction, the upper edge of these protrusions being bent slight toward the interior. After the terminal fitting 7 has been placed in the cavity 5, when an electric wire (not shown) is to be crimped within the barrel member 13, a crimping device (not shown) known as a crimper is inserted from above between the jig groove 10 and the barrel member 13, the bending of the aforementioned left and right protrusions facilitating this insertion.

The central portion of the terminal fitting 7 is provided with a pressure contact member 14 which serves to effect pressure contact between the terminal fitting 7 and the electric wire 15. This pressure contact member 14 has a pair of left and right pressure contact blades 14A and 14B in the anterior-posterior direction on both sides of the terminal fitting 7. These pressure contact blades 14A and 14B are formed by being cut out from both side faces of the pressure contact member 14. Further, the pressure contact blades 14A and 14B form a pair separated by a specified distance and face one another, the facing edges having sharp blades and forming a slot 4. When the electric wire 15 presses down on the slot 4, the blades cut into the insulation 16 as far as the core wire 17, thus bringing the core wire 17 into contact with the pressure contact blades 14A and 14B (see FIGS. 3 and 4).

In order to press in the electric wire 15 from above, the present embodiment employs a pressure contact mould 18 (see FIG. 2) which can be raised and lowered. The pressure contact mould 18 has three horizontal columns formed in a parallel manner so as to correspond to the cavities 5. This allows the pressure contact operation to be performed simultaneously on the electric wires 15 with respect to each terminal fitting 7. Three pressing protrusions 19 are formed on the lower face of the pressure contact mould 18 which push the electric wire 15 in the direction of the terminal fitting 7. Each pressing protrusion 19 is formed so as to be slightly longer than at least the space in the anterior-posterior direction between the pressure contact blades 14A and 14B of the terminal fitting 7. When the pressure contact mould 18 is lowered, the pressing protrusions 19 press the electric wire 15 into the corresponding slots 4 of the terminal fitting 7. Moreover, the pressing protrusions 19 have a cut-away portion 23 in that position where the pressing protrusions 19 would otherwise make contact against the pressure contact blades 14A and 14B as a result of the pressure contact mould 18 being lowered. Consequently, at the time of the pressing operation, an impact is avoided between the pressing protrusions 19 and the pressure contact blades 14A and 14B, and the pressing protrusions 19 can push the electric wire 15 deeply into the pressure contact blades 14A and 14B.

On the lower face of the pressure contact mould 18 and on both sides of each pressing protrusion 19 are a pair of pressing members 20 which constitute a widening prevention member of the present invention, and which protrude further downwards than the pressing protrusions 19. These pressing members 20 are formed separately from the pressing protrusions 19 and are attached to the lower side of springs 21 located within groove members 22 of the main body of the pressure contact mould 18, the springs 21 pushing the pressing members 20 downwards. These pressing members 20 are attached in such a way that they can be pressed into the groove members 22. The pressing members 20 are provided directly above the cut-out portions 8 formed on the corresponding cut-away walls 9. When the electric wires 15 are pushed downwards by the pressing protrusions 19, the pressing members 20 come into contact with the outer sides of both side faces of the pressure contact member 14 of the terminal fitting 7, and the lower edges of the pressing members 20 on the lower side of the pressure contact mould 18 make contact with the upper edges of the cut-away walls 9. In this manner, the pressing members 20 surround both side faces of the pressure contact member 14 from the outside and thereby control the widening of the side faces of the pressure contact member 14.

When the pressure contact mould 18 is pushed onto the terminal fitting 7, the pair of pressing members 20 first surround the side faces of the pressure contact member 14 of the terminal fitting 7. Next, since the pressing members 20 make contact with the cut-away wall 9, they are pushed in the direction of the groove member 22. Finally, the pressing protrusion 19 pushes the electric wire 15 in the direction of the pressure contact member 14. At this juncture, the widening of the terminal fittings 7 is controlled because the pressing members 20 are holding the side walls of the pressure contact member 14 in a fixed position. After the pressing operation of the electric wires 15 is completed, the pressure contact mould 18 is raised and the return of the pressing members 20 to their original position is effected by the springs 21.

Figure 3:
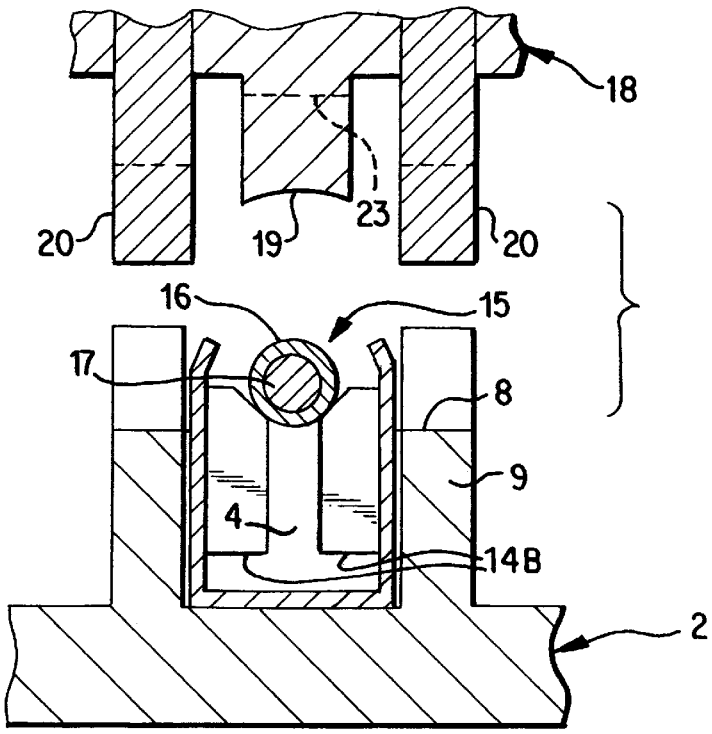
Figure 4:
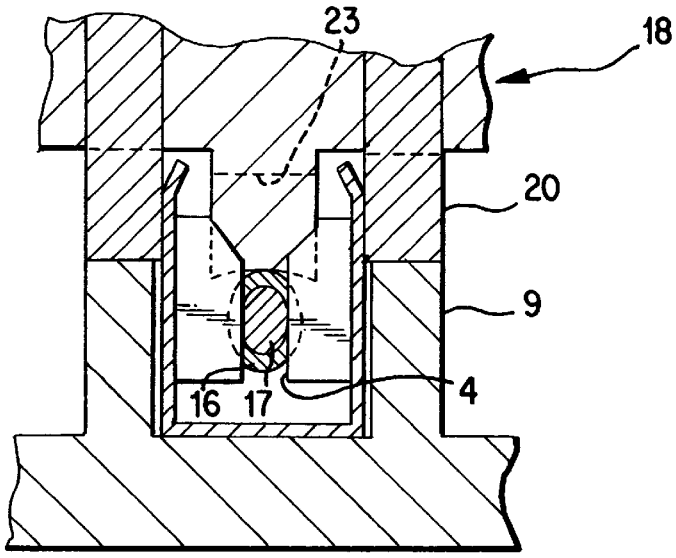
Figure 5:
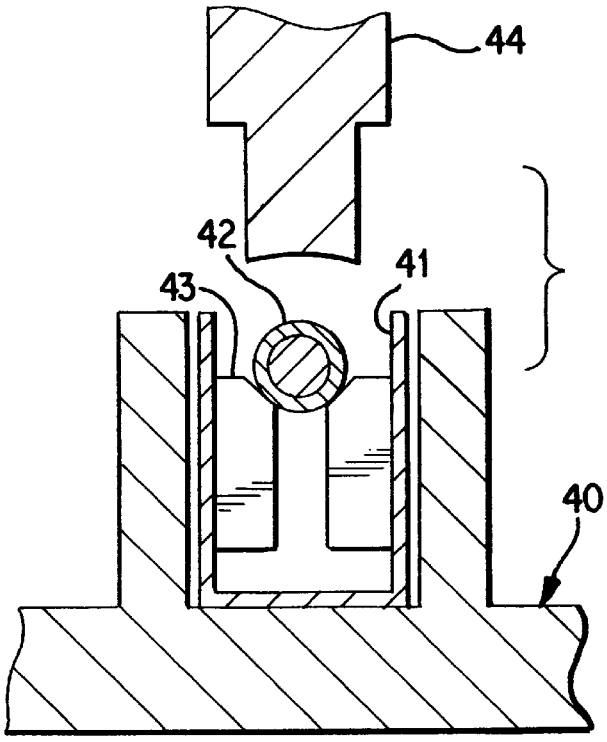
FIG. 5 PRIOR ART
Figure 6:
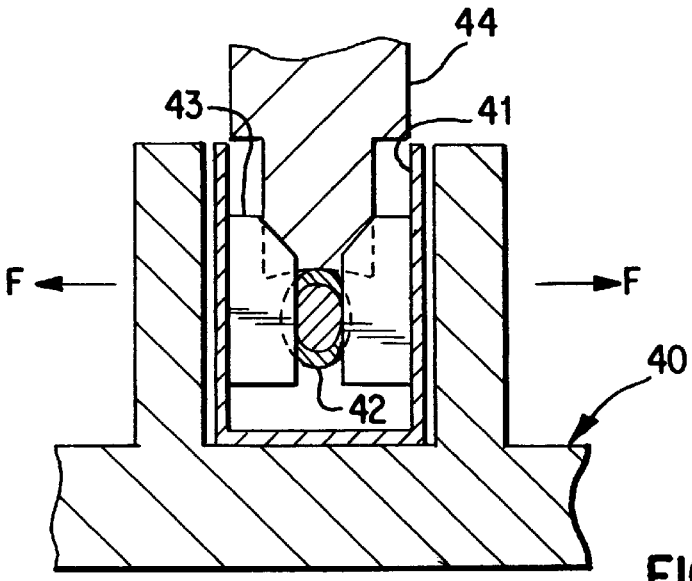
FIG. 6 PRIOR ART

The operation and effects of the present embodiment configured in the manner described above are explained. First, before the cover (not shown) is attached to this connector housing 2, the terminal fitting 7 is fitted within the cavity 5 of the connector housing 2 (FIG. 3). After this, the electric wire 15 is positioned in a specified position on top of the terminal fitting 7 and a pressure contact mould 18 is lowered. Next, pressing members 20 surround and fix both side walls of a pressure contact member 14 from the outside. The lower edges of the pressing members 20 make contact with the upper edges of the cut-away walls 9 and the pressing members 20 are pushed into the groove members 22. Meanwhile, the pressing protrusion 19 pushes the electric wire 15 into the slot 4 of the pressure contact blades 14A. Then, the pressure contact blades 14A cut into the covering 16 of the electric wire 15 and the core wire 17 comes into contact with the pressure contact blades 14A, thus making an electrical connection between the terminal fitting 7 and the electric wire 15. Subsequently, the barrel member 13 is crimped with respect to the covering 16 of the electric wire 15, completing the connection of the electric wire 15 and the terminal fitting 7.

In this manner, the connector 1 is completed by attaching a cover (not shown) to the connector housing 2 from above.

In the present embodiment, the pressure contact mould 18 is employed to press the electric wire 15 into the slot 4 of the terminal fitting 7 which is attached within the cavity 5 of the connector housing 2. Here, the pressing-in operation of the electric wire 15 is performed after the pressing members 20 provided on the pressure contact mould 18 join with the cut-out portions 8 outside the side faces of the pressure contact member 14. As a result, the terminal fitting 7 does not widen when the electric wire 15 is pressed in. Consequently, an effective pressing connecting force can be maintained between the core wire 17 and the terminal fitting 7.

Further, since the pressing members 20 join with the external sides of the pressure contact member 14 at the time of the pressing-in operation of the electric wire 15, the electric wire 15 can be pressed in and the widening of the terminal fitting 7 can be controlled all in a single operation.

The present invention is not limited to the embodiments described above. For example, the possibilities described below also lie within the technical range of the present invention.

(1) In the present embodiment, when the electric wire is pressed into the terminal fitting attached within the connector housing, widening is controlled by pressing both side faces of the pressure contact member located in each terminal fitting. In the case where the terminal fittings are provided entirely in a terminal housing chamber located within a connector housing, it may equally be arranged that the connector housing is pressed-in from both side faces.

(2) If the cover which is attached to the connector housing also serves as the lower face member of another connector housing as well as a cover, the connector housings can be placed one above the other. In this manner, a plurality of terminal fittings can be joined in a lengthwise direction. In this way a connector can be formed in a simple manner and space can easily be saved.

(3) The pressure contact operation between the terminal fitting and the electric wire need not be carried out only within a housing. It may equally be carried out with an individual terminal fitting.

What is claimed is:

1. An electrical connector comprising a housing having a cavity therein, said cavity being at least partially defined by a base and two upstanding sidewalls, an upper surface of each sidewall including a recess which extends along a portion of the cavity, and an electrical terminal within said cavity, the terminal having sidewalls and blade members defining a slot to receive an electrical wire by pressure contact, at least a portion of each terminal sidewall proximate said blade members being exposed along said cavity by said recesses so that as an assembly jig pushes a wire into said slot, pressing members of the jig enter the recesses and contact the exposed portion of each terminal sidewall to prevent the blade members from moving in a direction that would widen said slot.

2. A connector according to claim 1 wherein said recesses extend through the thickness of said walls.

3. In combination, an electrical connector and an assembly jig, said electrical connector comprising a housing having a cavity therein, said cavity being at least partially defined by a base and two upstanding sidewalls, an upper surface of each sidewall including a recess which extends along a portion of the cavity, and an electrical terminal within said cavity, the terminal having sidewalls blade members defining a slot to receive an electrical wire by pressure contact, at least a portion of each terminal sidewall proximate said blade members being exposed along said cavity by said recesses, said jig having a first limb adapted to urge the wire into said slot, and second limbs received into said recesses to directly contact the exposed portions of said terminal sidewalls proximate said respective blade members to prevent widening of said slot.

4. The combination of claim 3 wherein said second limbs are resiliently urged in a direction which is parallel to the height of said slot.

5. The combination of claim 3 wherein said connector has a plurality of aligned terminals, and opposite sides of one of said second limbs of said jig are adapted to engage the exposed portion of adjacent terminals.

6. The combination of claim 4 wherein said connector has a plurality of aligned terminals, and opposite sides of one of said second limbs of said jig are adapted to engage the exposed portion of adjacent terminals.

7. A method of inserting a wire into a blade connector comprising a connector housing and a terminal within said housing, said housing having a cavity being at least partially defined by a base and two upstanding sidewalls, an upper surface of each sidewall including a recess which extends along a portion of the cavity, said terminal having sidewalls and opposed blade members defining a wire-receiving slot, at least a portion of each said terminal sidewall proximate one of said blade members being exposed along said cavity by said recesses, the method comprising the steps of placing a wire over said slot;

moving a pressing member of an assembly jig into each recess to directly engage said exposed portion of each said terminal sidewall proximate one of said blade members to prevent widening of said slot; and pushing said wire into said slot with said jig.

8. A method according to claim 7 and including the step of providing the jig with support members to directly engage said recesses and a pushing member to push said wire, said support members being movable relative to said pushing member as the wire is pushed into said slot.

* * * * *